US006905307B2

(12) United States Patent
Kawarada et al.

(10) Patent No.: US 6,905,307 B2
(45) Date of Patent: Jun. 14, 2005

(54) STATIONARY VANES FOR TURBINES AND METHOD FOR MAKING THE SAME

(75) Inventors: Satoshi Kawarada, Wako (JP); Tsuneharu Kushida, Wako (JP); Kenji Kawamoto, Wako (JP); Hakaru Takamatsu, Wako (JP); Atsukuni Waragai, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 82 days.

(21) Appl. No.: 10/214,170

(22) Filed: Aug. 8, 2002

(65) Prior Publication Data

US 2003/0031564 A1 Feb. 13, 2003

(30) Foreign Application Priority Data

Aug. 10, 2001 (JP) ..... 2001-243617

(51) Int. Cl.[7] ..... F01D 9/02

(52) U.S. Cl. ..... 415/208.1; 415/191; 415/208.2; 29/557; 29/558; 29/889.7

(58) Field of Search ..... 415/191, 192, 415/208.1, 208.2, 210.1, 211.2, 185; 29/889.7, 557, 558

(56) References Cited

U.S. PATENT DOCUMENTS 2,599,654 A * 6/1952 Musikant ..... 415/208.1
2,654,277 A * 10/1953 Hedlund ..... 29/889.7
2,749,029 A * 6/1956 Goetzel et al. ..... 29/889.7
2,767,460 A * 10/1956 Schultz ..... 29/889.7
2,799,918 A * 7/1957 Goldthwaite et al. ..... 29/889.7
3,305,165 A * 2/1967 Gregory ..... 415/191
4,504,189 A * 3/1985 Lings ..... 415/192
4,669,164 A * 6/1987 Phelps ..... 29/558
5,246,339 A * 9/1993 Bengtsson et al. ..... 415/208.1
6,109,869 A * 8/2000 Maddaus et al. ..... 415/191
6,312,219 B1 * 11/2001 Wood et al. ..... 415/191

FOREIGN PATENT DOCUMENTS

AU 140341 A * 2/1951 ..... 29/889.7
GB 916672 A * 1/1963 ..... 415/208.1
GB 2073631 A * 10/1981 ..... 29/889.7
JP 5-312003 A * 11/1993 ..... 415/192
JP 10-196303 7/1998

* cited by examiner

*Primary Examiner*—Christopher Verdier
(74) *Attorney, Agent, or Firm*—Squire, Sanders & Dempsey L.L.P.

(57) ABSTRACT

The stator vane is provided with a leading edge which is cut into a different depth in dependence on a span-wise position so that a blade inlet angle may vary along a span-wise direction according to a prescribed pattern. By thus optimizing the depth of the cut along the leading edge of the stator vane, the leading edge blade inlet angle can be optimized along the entire length of the stator vane even if the stator vane consists of a two-dimensional aerofoil, and the vane is provided with a substantially conformal cross section in parts which are not affected by the cut in the leading edge. Thereby, the efficiency of the turbine can be optimized while minimizing the cost.

11 Claims, 4 Drawing Sheets

STATIONARY VANES FOR TURBINES AND METHOD FOR MAKING THE SAME

TECHNICAL FIELD

The present invention relates to stationary vanes suitable for use in axial gas turbines and steam turbines, and a method for making such stationary vanes. In particular, the present invention relates to stationary vanes that provide a high efficiency, and can be manufactured both easily and at low cost, and a method for making such stationary vanes.

BACKGROUND OF THE INVENTION

Conventionally, various aerofoils have been proposed for the stationary vanes of gas turbines and steam turbines to optimize efficiency. For instance, Japanese patent laid open (kokai) publication No. 10-196303 discloses a proposal in which the aerofoil is curved along the span-wise direction either to the back or belly of the aerofoil so as to minimize the loss due to the generation of secondary flows. It is also known to slightly twist the aerofoil around a span axis to thereby vary the blade inlet angle of the aerofoil along the span-wise direction. Such aerofoils are called as three-dimensional aerofoils, and are effective in improving the efficiency of the turbine. However, as they have to be made either by casting or by computer-controlled machining, the manufacturing process is both complex and expensive.

BRIEF SUMMARY OF THE INVENTION

In view of such problems of the prior art, a primary object of the present invention is to provide stationary vanes for turbines that are efficient and can be manufactured both easily and economically.

A second object of the present invention is to provide stationary vanes for turbines that can be made from roll formed or extruded material without requiring an extensive machining process or an elaborate casting process.

A third object of the present invention is to provide a method for making such stationary vanes.

According to the present invention, such objects can be accomplished by providing a stator vane for a turbine, characterized by that: the vane is provided with a leading edge which is cut into a different depth in dependence on a span-wise position so that a blade inlet angle may vary along a span-wise direction according to a prescribed pattern.

By thus optimizing the depth of the cut along the leading edge of the stator vane, the leading edge blade inlet angle can be optimized along the entire length of the stator vane even if the stator vane consists of a two-dimensional aerofoil, and the vane is provided with a substantially conformal cross section in parts which are not affected by the cut in the leading edge. Thereby, the efficiency of the turbine can be optimized.

Thus, the vane may be made of a roll formed plate member or an extruded plate member.

The stator vane defined above can be manufactured by preparing a plate member having a substantial same cross section substantially over an entire length thereof; and cutting a side edge of the plate member by a varying depth along an axial length thereof according to a prescribed pattern. The cut leading edge may be beveled, chamfered or otherwise rounded.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
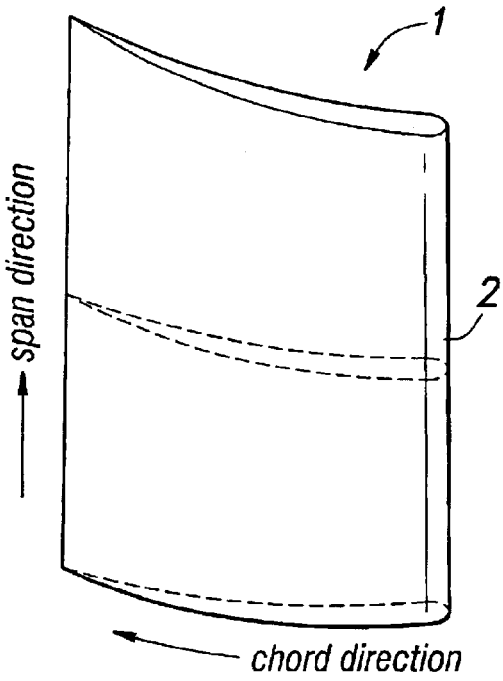
Fig. 1 PRIOR ART
FIG. 1 is a perspective view of a conventional three-dimensional stator vane.

FIG. 1 shows a conventional three-dimensional stator vane 1 which is slightly twisted around a span axis. In other words, the chord direction varies depending on the position along the span direction. According to this structure, the distribution of the blade inlet angle of the leading edge 2 along the span direction can be selected at will so that the efficiency of the turbine can be optimized in a favorable manner. However, because the cross sectional shape of the vane varies along the span direction, a casting process or computer-controlled machining process is required for the manufacture of the vane, and this causes a high manufacturing cost.

Figure 2:
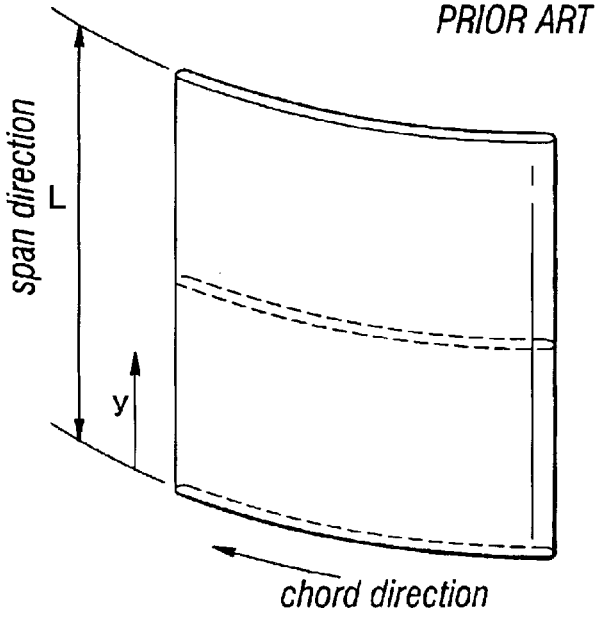
Fig. 2 PRIOR ART
FIG. 2 is a perspective view of a conventional two-dimensional stator vane.

FIG. 2 shows a simple two-dimensional vane which is formed by bending a plate member. A certain minimum wall thickness is required to be ensured for a casting process to be executed in a satisfactory manner. On the other hand, if the vane is made of light-weight plate member, the wall thickness can be determined at will, and a more light-weight design is possible as compared to a comparable cast three-dimensional vane. In this case, because the cross sectional shape is fixed along the span direction, the manufacturing process is both simple and economical, but a certain drop in the efficiency is inevitable because the blade inlet angle of the leading edge 2 is fixed along the span direction.

Figure 3:
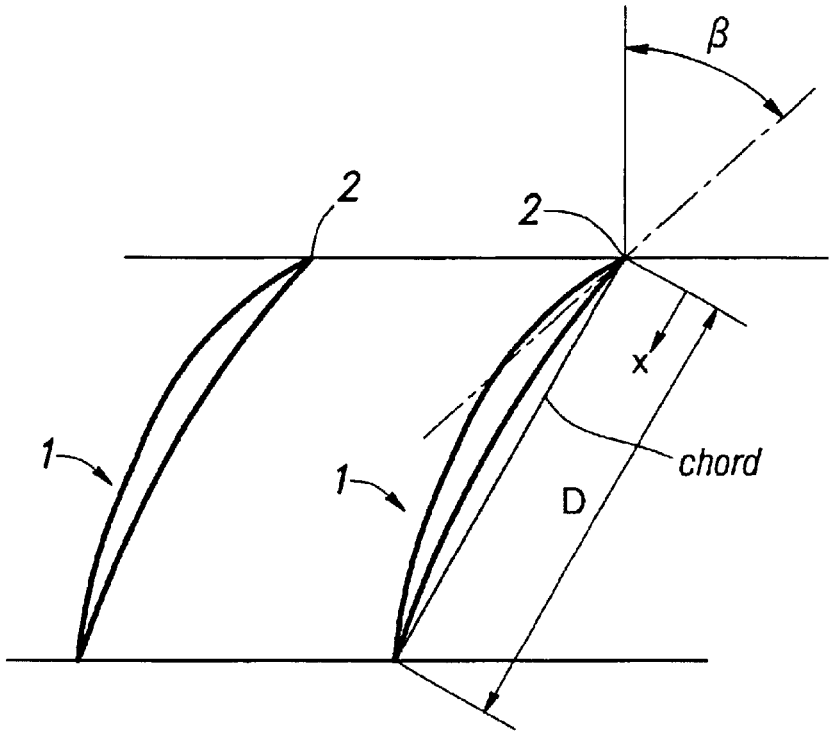
FIG. 3 is a schematic view of a stator vane array showing the definition of the leading edge blade inlet angle.

FIG. 3 schematically illustrates an array of turbine stator vanes, and shows the definition of the leading edge blade inlet angle β. The leading edge blade inlet angle β is given as the angle of the tangent of the center line of the leading edge with respect to the axial direction of the turbine. Typically, the leading edge blade inlet angle should align with the direction of the incoming flow or the flow inlet angle, but the actual flow inlet angle varies depending on the radial position of the turbine or the span-wise position of each vane.

Figure 4:
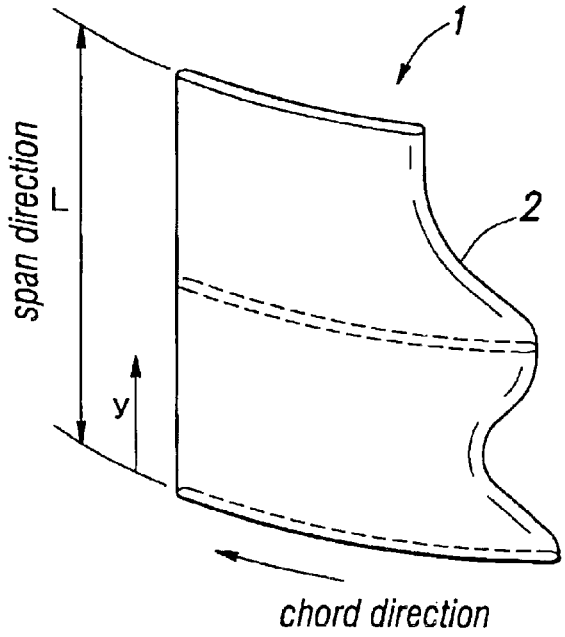
FIG. 4 is a perspective view of a two-dimensional stator vane having a leading edge cut into a different depth along the span-wise direction thereof according to the present invention.

FIG. 4 shows a two-dimensional stator vane according to the present invention. In this case also, the stator vane 1 is formed by bending a plate member. The cross section of the work piece is conformal along the span direction thereof, but the stator vane is subjected to a machining process so as to have a chord length which varies depending on the span-wise position. Thus, the vane is provided with a substantially conformal cross section in parts which are not affected by the cut in the leading edge.

The machined part of the stator vane is appropriately beveled, chamfered or otherwise rounded so as to eliminate any cause of aerodynamic losses. The stator vane 1 may also be formed from an extruded member. The cross section of the vane 1 may consist of either an aerofoil configuration for an optimum aerodynamic performance or a more simple shape for an economic advantage.

Figure 5:
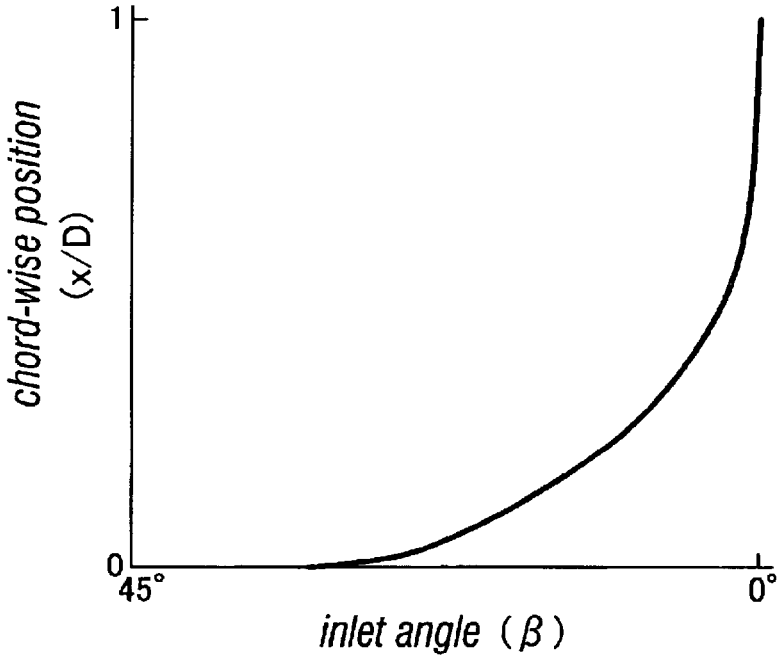
FIG. 5 is a graph showing the relationship between the cut depth and leading edge blade inlet angle β.

FIG. 5 is a graph showing the change of the leading edge blade inlet angle β in dependence on the depth of the machined cut x from the nominal leading edge of a vane having the chord length of D. The necessary cut depth for a desired value of the leading edge blade inlet angle β can be obtained from this graph.

Figure 6:
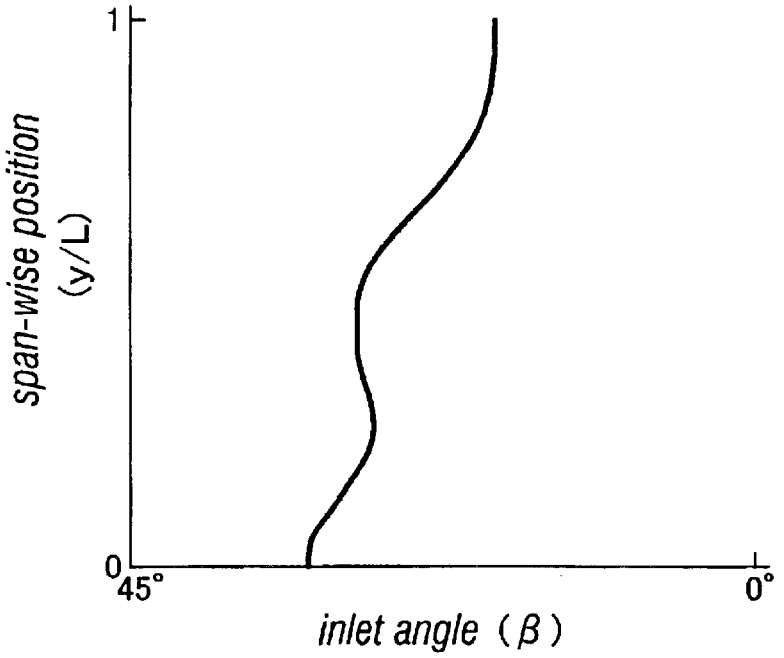
FIG. 6 is a graph showing a desired distribution of cut depth along the span-wise direction of the vane.

FIG. 6 is a graph that shows the distribution of the desired flow inlet angle or the blade inlet angle in dependence on the span-wise position y in a turbine using vanes having a span length of L. By determining the cut depth from the nominal leading edge in dependence on the span-wise position y according to the data represented in FIGS. 5 and 6, an optimum vane design can be achieved.

Figure 7:
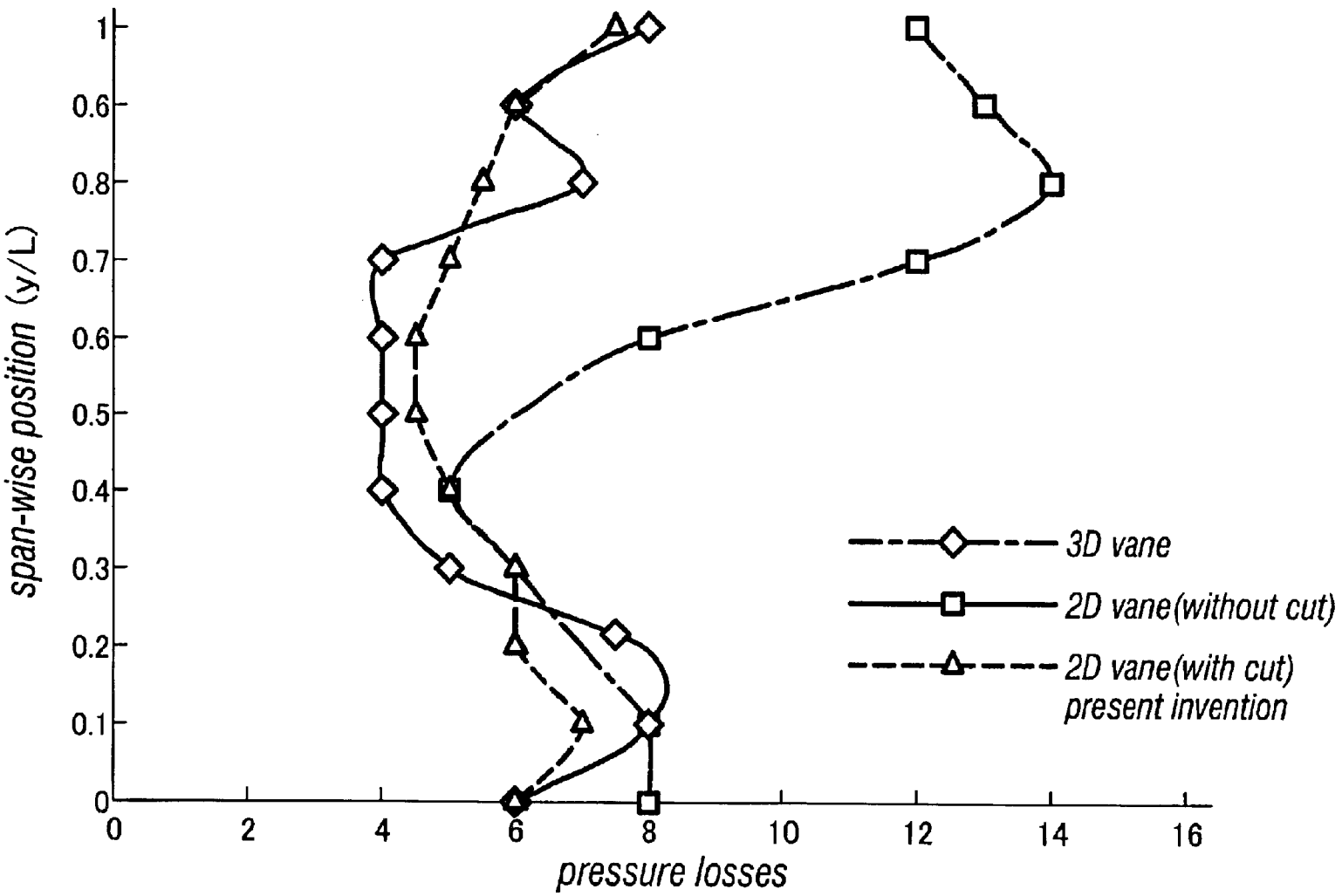
FIG. 7 is a graph showing the distributions of pressure loss along the span-wise direction of the vane for the three different kinds of the stator vanes.

FIG. 7 shows the distributions of pressure loss in dependence on the span-wise direction for vanes having different cross sectional shapes. When a simple two-dimensional vane is used, a substantial pressure loss is produced in a span-wise outer end of the vane. However, a two-dimensional vane provided with a cut in the leading edge according to the present invention can reduce the pressure loss to a substantially same level as that of a three-dimensional vane.

Thus, according to the present invention, an efficiency comparable to that of a three-dimensional vane can be achieved while the cost and weight can be reduced to those of a two-dimensional vane.

Although the present invention has been described in terms of a preferred embodiment thereof, it is obvious to a person skilled in the art that various alterations and modifications are possible without departing from the scope of the present invention which is set forth in the appended claims.

What is claimed is:

1. A stator vane for a gas turbine engine made of a plate member having a relatively constant thickness, characterized by that:

said vane is provided with a leading edge which is cut into a different depth in dependence on a span-wise position so that a blade inlet angle may vary along a span-wise direction according to a prescribed pattern;

the leading edge including a receding portion adjacent to a base end of said vane that includes a portion progressively receding from the base end of said vane and presenting a concave shape and an advancing portion in a middle portion of the vane that are smoothly connected to adjacent parts, the advancing portion presenting a convex shape.

2. A stator vane according to claim 1, wherein said vane is provided with a substantially conformal cross section in parts which are not affected by said cut in said leading edge.

3. A stator vane according to claim 1, wherein said vane is made of a roll formed plate member.

4. A stator vane according to claim 1, wherein said vane is made of an extruded plate member.

5. A stator vane according to claim 1, wherein said cut leading edge is rounded.

6. A method of making a stator vane for a gas turbine engine, comprising the steps of:

preparing a plate member having a substantial same thickness substantially over an entire width of the plate member; and cutting a side edge of said plate member by a varying depth along an axial length thereof in such a pattern that the side edge includes a receding portion adjacent to a base end of said vane that includes a portion progressively receding from the base end of said vane and presenting a concave shape and an advancing portion in a middle portion of the plate member that are smoothly connected to adjacent parts of said side edge the advancing portion presenting a convex shape.

7. A method of making a stator vane according to claim 6, wherein said vane is made of a roll formed plate member.

8. A method of making a stator vane according to claim 6, wherein said vane is made of an extruded plate member.

9. A method of making a stator vane according to claim 6, wherein said cut side edge is rounded.

10. The stator vane according to claim 1, wherein a change in said blade inlet angle corresponds to said different depth cut into said leading edge.

11. A method of making a stator vane according to claim 6, wherein said cutting step comprises setting said varying depth according to a change in a blade inlet angle of said side edge.

* * * * *